United States Patent [19]

Takada

[11] Patent Number: 4,565,547

[45] Date of Patent: Jan. 21, 1986

[54] DETERGENT COMPOSITION FOR FUEL-SYSTEM PARTS

[75] Inventor: Toshiya Takada, Aichi, Japan

[73] Assignees: Toyoto Jidosha Kabushiki Kaisha, Toyoto; Japan Bars Company Limited, Osaka, both of Japan

[21] Appl. No.: 627,476

[22] Filed: Jul. 3, 1984

[30] Foreign Application Priority Data

Jul. 12, 1983 [JP] Japan ..... 58-126762

[51] Int. Cl.[4] ..... C10L 1/14

[52] U.S. Cl. ..... 44/51; 44/66; 44/72

[58] Field of Search ..... 134/19, 20, 39; 252/118, 122, 132; 44/52, 51, 50, 53, 56, 66, 72

[56] References Cited

U.S. PATENT DOCUMENTS 1,589,885 6/1926 Howard ..... 44/52
1,692,784 11/1928 Orelup ..... 44/66
2,251,988 8/1941 Curran ..... 134/20
3,658,495 4/1972 Dorer, Jr. ..... 44/66

*Primary Examiner*—Paul Lieberman
*Assistant Examiner*—John F. McNally
*Attorney, Agent, or Firm*—Oblon, Fisher, Spivak, McClelland & Maier

[57] ABSTRACT

The detergent composition of this invention, which is suitable for fuel-system parts, contains a saturated or unsaturated fatty acid containing 18 carbon atoms, a mixture of ammonia and amine an ester of a higher fatty acid, and water. It is also possible to add an antioxidant and a metal-deactivating agent. When mixing the above components, it is also possible to use a diluent and a solubilizing auxiliary solvent in order to impart suitable degrees of viscosity, fluidity and phase-solubility.

Therefore, it is capable of removing foreign matter stuck on the fuel-system parts in a shorter period of time and gives less deleterious effects not only to fuel but also to various materials used to make up the fuel-system parts.

7 Claims, No Drawings

DETERGENT COMPOSITION FOR FUEL-SYSTEM PARTS

BACKGROUND OF THE INVENTION

1. Field of the Invention

This invention relates to a detergent composition for fuel-system parts, which detergent composition is applied by adding same to fuel.

2. Description of the Invention

Conventional detergent compositions for fuel-system parts were added at several tens to several thousands parts per million (ppm) to fuel so that gum, varnish, carbon deposit and the like built up on the fuel-system parts of vehicles would have gradually been rendered cleaner while using the same vehicles over prolonged periods of time. It was thus difficult to solve, with such conventional detergent compositions, engine troubles in shorter periods of time when some foreign matter had stuck on fuel-system parts and had developed such engine troubles.

SUMMARY OF THE INVENTION

With the above-described problem in view, an object of this invention is to provide a detergent composition for fuel-system parts, which detergent composition is capable of removing foreign matter stuck on the fuel-system parts in a shorter period of time (within 100 km of driving) and gives less deleterious effects not only to fuel such as gasoline but also to various materials used to make up the fuel-system parts.

DETAILED DESCRIPTION

The present inventors have carried out various experiments with a view toward achieving the above object. As a result, the following facts were discovered and confirmed. Firstly, foreign matter stuck and deposited on fuel-system parts includes both foreign matter formed at lower temperatures and relatively easy to remove, such as gum varnish and the like, and foreign matter developed at higher temperatures and difficult to move, such as carbonaceous foreign matter and the like. Foreign matter formed at such lower temperatures can be satisfactorily removed with a chlorinated-hydrocarbon type solvent or aromatic solvent which is a component of conventional detergent compositions for fuel-system parts. However, the efficiency of such a solvent is not sufficient for foreign matter formed at higher temperatures. The present inventors also found that anionic surfactants of a certain sort can exhibit superb effects for the removal of foreign matter developed at higher temperatures, water has a considerably good effect for the removal of carbonaceous foreign matter, and some esters of higher fatty acids are able to enhance the cleaning effect of such compositions and to ensure their high-temperature and low-temperature stability.

The present invention has been completed on the basis of the above-mentioned finding and discovery. Accordingly, the present invention provides a detergent composition for fuel-system parts, comprising 5–20 parts by weight of a saturated or unsaturated fatty acid containing 18 carbon atoms, 2–15 parts by weight of a mixture of ammonia and an amine, 5–20 parts by weight of an ester of a higher fatty acid, and 5–15 parts by weight of water.

As the saturated or unsaturated fatty acid containing 18 carbon atoms, stearic acid, oleic acid, linoleic acid, linolenic acid or ricinoleic acid or a mixture thereof is suitable.

Ammonia and the amine serve to neutralize the above-mentioned fatty acid into an anionic surfactant. The proportion of the mixture of ammonia and the amine is 2–15 parts by weight based on 5–20 parts by weight of the fatty aid. More strictly speaking, it is preferred to add the mixture of ammonia and the amine in an amount somewhat exceeding the chemical equivalent of the fatty acid (in other words, in such an amount that makes the resulting composition have a pH of 9–10).

The molar ratio of ammonia to the amine may approximately be from ½ to 2/1, or more preferably 1/1. By the way, neither ammonia nor the amine can exhibit significant effect for removal of foreign matter if they are incorporated singly.

As the amine, monoisopropanolamine shows particularly good effect. Some problems may be developed with respect to such stability as low-temperature and high-temperature stability, depending on the type of the amine. Besides monoisopropanolamine, it is possible to use alkylamines containing 1–10 carbon atoms, alkanolamines containing 2–10 carbon atoms, morpholine and the like, either singly or in combination.

The ester of the higher fatty acid acts as non-ionic surfactant. The sorbitan or polyoxyethylenesorbitan ester of the higher fatty acid is suitable. More specifically, it is feasible to employ sorbitan monoplamitate, sorbitan monooleate, sorbitan trioleate, polyoxyethylenesorbitan monostearate, polyoxyethylenesorbitan monooleate, and so on. The ester of the higher fatty acid is effective in allowing the free ammonia and amine, which are components of each detergent composition for fuel-system parts according to this invention, to exist stably in fuel so as to enhance the cleaning effect. It also serves to enhance the high-temperature and low-temperature stability of the composition when mixed with fuel such as gasoline.

On the other hand, water is effective in increasing the cleaning capacity for foreign matter formed at higher temperature, such as carbonaceous foreign matter, to a considerable extent.

The proportion of water is from 5 to 15 parts by weight per 5–20 parts by weight of the above-mentioned fatty acid. Water cannot exhibit its removing effect for carbonaceous foreign matter to any significant extent if it should be contained in any amounts less than 5 parts by weight. When incorporated in any amounts exceeding 15 parts by eight on the other hand, it tends to deteriorate the low-temperature and high-temperature stability of the composition and at the same time to develop freezing at low temperatures and phase separation at high temperatures. When water is added in such an excess amount, it induces such a danger that the electrical insulation of such fuel-system parts would be lowered.

The detergent composition of this invention, which is suitable for fuel-system parts, contains the above-described fatty acid, free alkaline compounds, ester of higher fatty acid and water as essential components thereof. It is also possible to add an antioxidant and a metal-deactivating agent to the detergent composition of this invention so as to avoid oxidation action which may be accelerated by the heat of the fuel system and the co-existence of metal used as fuel-system parts in the course of application of the detergent composition.

It is particularly effective to use a phenol derivative such as styrenated phenol or 2,6-di-tert-buty-4-methylphenol as the antioxidant. Such a phenol derivative is also preferred owing to its good solubility in fuel. As the metal-deactivating agent, benzotriazole, tolyltriazole or the like is effective, especially for the deactivation of copper and copper-base alloys. It has also been conformed that such a metal-deactivating agent can suppress the accleration of fuel oxidation by copper ions.

When mixing the above components, it is also possible to use kerosine, gasoline, petroleum naphtha, aromatic solvent, mineral oil and/or synthetic oil as a diluent in order to impart suiable degrees of viscosity, fluidity and phase-solubility to resulting detergent composition. Besides, it is also feasible to incorporate, as a solubilizing auxiliary solvent, an aliphatic alcohol such as isopropyl alcohol, n-butanol, iso-butanol or hexyl alcohol, and a solvent of the glycol ether type such as ethylene glycol monomethyl ether, ethylene glycol monoethyl ether or ethlene glycol monobutyl ether.

The diluted and solubilizing auxiliary solvent may be incororated in amounts of 20–60 parts by weight and 10–30 parts by weight of respectively, both based on 5–20 parts by weight of the fatty acid.

The detergent composition of this invention, which is suitable for fuel-system parts, may be added at 1,000 ppm to 30,000 ppm (0.1 to 3.0%) to vehicle fuel such as gasoline, when it is actually employed. Addition of the detergent composition for fuel-system parts is effective not only in removing already-deposited foreign matter efficiently but also in preventing further deposition of foreign matter such as gum on the fuel-system parts.

DESCRIPTION OF THE PREFERRED EMBODIMENTS

Hereinafter, the present invention will be described in more detail in the following Example.

First of all, two types of compositions, which will be identified respectively as Composition A and Composition B, were prepared as detergent compositions according to this invention, which detergent compositions are suitable for fuel-system parts. Additional two types of compositions, i.e., Composition R1 and Composition R2 were also prepared for the sake of comparison.

| Component | Parts by weight |
|---|---|
| Composition A | |
| Oleic acid | 15 |
| Butylamine | 5 |
| Aqueous ammonia solution (28%) | 5 |
| Sorbitan monooleate | 10 |
| Water | 15 |
| Butyl cellosolve | 10 |
| Isopropanol | 10 |
| Petroleum naphta | 20 |
| Machine oil | 10 |
| Total | 100 |
| Composition B | |
| Oleic acid | 10 |
| Monoisopropanolamine | 4 |
| Butylamine | 5 |
| Polyoxyethylenesorbitan monooleate | 15 |
| Water | 10 |
| Butyl cellosolve | 10 |
| Butanol | 10 |
| Styrenated phenol | 0.5 |
| Benzotriazole | 0.5 |
| Petroleum naphtha | 20 |
| Synthetic oil | 15 |

-continued

| Component | Parts by weight |
|---|---|
| Total | 100 |
| Composition R1 | |
| Oleic acid | 10 |
| Monoisopropanolamine | 5 |
| Aqueous ammonia solution (28%) | 5 |
| Water | 15 |
| Butyl cellosolve | 10 |
| Butanol | 10 |
| Kerosine | 30 |
| Motor oil | 15 |
| Total | 100 |
| Composition R2 | |
| Linoleic acid | 15 |
| Monoisopropanolamine | 5 |
| Morpholine | 4.5 |
| Polyoxyethylenesolbitan monostearate | 10 |
| Water | 0.5 |
| Isobutylcarbinol | 15 |
| Butanol | 20 |
| Petroleum naphtha | 15 |
| Synthetic oil | 15 |
| Total | 100 |

In order to investigate the foreign matter removing effect of four types of compositions, metal pieces were cut off as specimens from parts on which foreign matter such as gum and the like had deposited. They were immersed in gasoline solutions which contained 1% by volume of the compositions respectively. The gasoline solutions were maintained at 50° C. After an elapsed time of a predetermined period, the specimens were pulled out of their respective gasoline solutions and their weights were then measured. The weight of foreign matter removed from each specimen owing to its elution or separation during the immersion period was determined on the basis of the difference betweem its weight before the immersion and that after the immersion. Finally each metal piece was weighed in a completely-cleaned state so as to determine the weight of the specimen itself and that of foreign matter deposited on the specimen before its cleaning. Supposing the latter weight as 100, the percentage reduction of the weight of the foreign matter which weight was measured after its immersion was calculated in terms of wt.%.

The same experiment was repeated. Substantially equal tendency was observed, although slightly-different results were obtained depending on the types of deposited foreign matter and the extents the deposition.

Furthermore, the following tests were carried out using, as specimens, various materials cut off from parts in fuel systems with a view toward determining the influence of the above compositions on such various materials.

As metal material, were used specimens as copper, brass, aluminium and zinc which were all cut off from fuel-system parts. They were immersed at 60° C. for different time periods up to 1,000 hours. Their surface appearance and weight changes were investigated. NBR and fluororubber were used as specimens for rubber materials. They were immersed at 40° C. for 150 hours. Percentage variations in their weights, volumes and hardness were investigated. On the other hand, nylon, polyester and phenol resin were used as plastic materials. They were immersed at 60° C. for 1,000 hours. Percentage variations in their weights, volumes, tensile strength and impact strength were inventigated.

From results of the above tests, the influence of the above compositions to the various materials used in fuel systems was evaluated.

In addition, in connection with those used in electrical systems among the above-tested fuel-system parts, their electrical properties such as electrically-insulating capacities were additionally investigated before and after their immersion.

of abundant peroxides. The difference may be attributed to a hypothesis that the amine, ammonia and other components were not allowed to exist stably in the fuel due to lack of any ester of higher fatty acid. No particularly significant differences were observed with respect to influence to various materials in fuel systems.

Composition R1 showed particularly poor results with respect to electrically-insulating capacity.

TABLE

| | Property | | | | | | | | | | |
|---|---|---|---|---|---|---|---|---|---|---|---|
| | Foreign matter removing capacity Percentage weight reduction | | | Influence to various materials in fuel system | | | Electric insula- | Influence to gasoline | | | |
| | | | | | | | | Stability against oxidation | | Mixing stability | |
| Composition | 30 min. later | 60 min. later | 90 min. later | Metals | Rubbers | Plastics | tion | Induction period (min.) | Peroxides (mg/liter) | −20 C | 50 C |
| Composition A | 31 | 76 | 94 | Δ Acc | Δ | | Δ | 480 | 136 | | |
| Composition B | 29 | 88 | 95 | Good | | | | 600 or longer | 80 or less | | |
| Composition R1 | 56 | 94 | 100 | Δ | Δ | Δ | X | 180 | 3200 | X | Δ |
| Composition R2 | 15 | 17 | 34 | | | | | 600 or longer | 80 or less | Δ | |
| Blank (gasoline) | 3 | 7 | 9 | | | | | 600 | 80 | — | — |

Furthermore, oxidation-inducing periods were measured under elevated oxygen pressure in autoclaves, using gasoline samples added respectively with 1% by volume of the compositions. Besides, the amounts of peroxides formed for 4 hours under elevated oxygen pressure in the same autoclaves were also measured.

The above compositions were added to and mixed with gasoline. The resulting gasoline samples were allowed to stand for 24 hours respectively at a low temperature (−20° C.) and at a high temperature (50° C.). Thereafter, the stability of each gasoline sample was evaluted.

The below-described table shows results of the influence tests of the detergent compositions A, B, R1 and R2 on various fuel-system materials, in which the marks O, Δ and X indicate "good", "acceptable" and "bad" respectively.

The foreign matter removing effects of Compositions A and B, which were examples of the detergent composition of this invention, were respectively 94 wt.% and 95 wt.% respectively. On the other hand, the foreign matter removing effects of Compositions R1 and R2 were 100 wt.% and 34 wt.% respectively.

The low foreign matter removing effect of Composition R2, namely, 34 wt.% may be attributed to its low proportion of water. Pure gasoline, which was employed as blank, showed extremely slight effects for the removal of foreign matter formed at lower temperatures.

With respect to the influence to gasoline, the time periods passed until the initiation of deterioration of the gasoline samples added respectively with Compositions A and B of this invention (namely, the oxidation-inducing periods) and the amount of peroxides formed in the same gasoline sample were similar to those of the blank gasoline. However, Composition R1 and the shorter oxidation-inducing period and resulted in the formation

What is claimed is:

1. A gasoline suitable for use internal combustion engines, comprising:

a detergent consisting essentially of 5–20 parts by weight of a saturated or unsaturated fatty acid containing 18 carbon atoms, 2–15 parts by weight of a mixture of ammonia and an amine selected from the group consisting of alkylamines of 1–10 carbon atoms, alkanolamines containing 2–10 carbon atoms, morpholine, and mixtures thereof, 5–20 parts by weight of an ester of a higher fatty acid, and 5–15 parts by weight water, and a hydrocarbon fuel containing said detergent in about 1,000–30,000 ppm.

2. A hydrocarbon fuel as claimed in claim 1, wherein the amine is one or more amines selected from the group consisting of alkylamines containing 1–10 carbon atoms and morpholine.

3. A hydrocarbon fuel as claimed in claim 2, wherein the amine is monoisopropanolamine.

4. A hydrocarbon fuel as claimed in claim 1, wherein the composition further comprises an antioxidant and a metal-deactivating agent.

5. A hydrocarbon fuel as claimed in claim 1, wherein the ester is sorbitan or polyoxyethylenesorbitan ester.

6. A hydrocarbon fuel as claimed in claim 1, wherein the composition further comprises 10–30 parts by weight of a solubilizing auxiliary solvent and 20–60 parts by weight of a diluting solvent.

7. A hydrocarbon fuel as claimed in claim 6, wherein said solubilizing auxiliary solvent is one selected from th group consisting of alcohol and glycol ether and the mixture thereof and said diluting solvent is one selected from the group consisting of kerosine, gasoline petroleum naphtha and the mixture thereof.

* * * * *